US011268044B2

(12) United States Patent
Debord et al.

(10) Patent No.: US 11,268,044 B2
(45) Date of Patent: Mar. 8, 2022

(54) LONG DURATION FUEL ECONOMY LUBRICATING COMPOSITION

(71) Applicant: TOTAL MARKETING SERVICES, Puteaux (FR)

(72) Inventors: Mickael Debord, Saint Genis Laval (FR); Catherine Charrin, Messimy (FR); Julien Guerin, Villeurbanne (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 15/747,039

(22) PCT Filed: Jul. 22, 2016

(86) PCT No.: PCT/EP2016/067481

§ 371 (c)(1),
(2) Date: Jan. 23, 2018

(87) PCT Pub. No.: WO2017/013238

PCT Pub. Date: Jan. 26, 2017

(65) Prior Publication Data

US 2019/0010418 A1 Jan. 10, 2019

(30) Foreign Application Priority Data

Jul. 23, 2015 (FR) ..... 1557012

(51) Int. Cl.

| | |
|---|---|
| ***C10M 169/04*** | (2006.01) |
| ***C10M 141/12*** | (2006.01) |
| ***C10M 135/26*** | (2006.01) |
| ***C10M 137/10*** | (2006.01) |
| ***C10M 139/00*** | (2006.01) |
| ***C10M 155/00*** | (2006.01) |
| ***C10M 161/00*** | (2006.01) |
| *C10N 10/12* | (2006.01) |
| *C10N 30/06* | (2006.01) |
| *C10N 30/00* | (2006.01) |
| *C10N 40/25* | (2006.01) |
| *C10N 60/14* | (2006.01) |

(52) U.S. Cl.

CPC ..... *C10M 169/044* (2013.01); *C10M 135/26* (2013.01); *C10M 137/10* (2013.01); *C10M 139/00* (2013.01); *C10M 141/12* (2013.01); *C10M 155/00* (2013.01); *C10M 161/00* (2013.01); *C10M 169/04* (2013.01); *C10M 2201/087* (2013.01); *C10M 2203/003* (2013.01); *C10M 2203/1025* (2013.01); *C10M 2207/026* (2013.01); *C10M 2207/125* (2013.01); *C10M 2207/262* (2013.01); *C10M 2209/084* (2013.01); *C10M 2209/102* (2013.01); *C10M 2215/064* (2013.01); *C10M 2215/28* (2013.01); *C10M 2219/068* (2013.01); *C10M 2219/085* (2013.01); *C10M 2223/045* (2013.01); *C10M 2227/061* (2013.01); *C10M 2227/062* (2013.01); *C10M 2227/066* (2013.01); *C10M 2229/00* (2013.01); *C10N 2010/12* (2013.01); *C10N 2030/06* (2013.01); *C10N 2030/54* (2020.05); *C10N 2040/25* (2013.01); *C10N 2060/14* (2013.01)

(58) Field of Classification Search

CPC ..... C10M 2227/061; C10M 2219/068; C10M 161/00; C10M 141/12; C10M 135/26; C10M 169/04; C10M 139/00; C10M 155/00; C10M 137/10; C10M 169/044; C10M 2229/00; C10M 2223/045; C10M 2207/125; C10M 2207/262; C10M 2207/026; C10M 2215/28; C10M 2227/066; C10M 2219/085; C10M 2227/062; C10M 2201/087; C10M 2203/003; C10M 2215/064; C10M 2203/1025; C10M 2209/102; C10M 2209/084; C10N 2010/12; C10N 2030/06; C10N 2030/54; C10N 2060/14; C10N 2040/25; C10N 2010/04; C10N 2020/02

See application file for complete search history.

(56) References Cited

U.S. PATENT DOCUMENTS

| | | | |
|---|---|---|---|
| 4,889,647 | A | 12/1989 | Rowan et al. |
| 5,412,130 | A | 5/1995 | Karol |
| 5,658,862 | A | 8/1997 | Vrahopoulou |

(Continued)

FOREIGN PATENT DOCUMENTS

| | | | |
|---|---|---|---|
| EP | 0 546 357 | A1 | 6/1993 |
| EP | 1 757 673 | A1 | 2/2007 |

(Continued)

OTHER PUBLICATIONS

International Search Report, dated Aug. 31, 2016, from corresponding PCT/EP2016/067481 application.

*Primary Examiner* — Vishal V Vasisth
(74) *Attorney, Agent, or Firm* — Nixon & Vanderhye

(57) ABSTRACT

In the field of lubricating compositions, in particular to the Fuel Economy (FE) properties of lubricating compositions, there is disclosed the combined use of at least one derivative of molybdenum and at least one derivative of boron to maintain the Fuel Economy (FE) properties of a lubricating composition also including at least one base oil. Also disclosed is a use, within a lubricating composition including at least one base oil, of a combination of at least one derivative of molybdenum and at least one derivative of boron, and at least 30 ppm and at most 600 ppm of born boron relative to the weight of the lubricating composition to preserve the Fuel Economy (FE) properties of this lubricating composition.

9 Claims, No Drawings

(56) References Cited

U.S. PATENT DOCUMENTS

| | | | | |
|---|---|---|---|---|
| 2009/0186784 | A1* | 7/2009 | Diggs | C10M 167/00 508/155 |
| 2010/0152074 | A1* | 6/2010 | Nelson | C10M 141/12 508/108 |
| 2013/0072408 | A1* | 3/2013 | Adams | C10M 129/76 508/497 |
| 2015/0175923 | A1 | 6/2015 | Gaal et al. | |
| 2015/0175925 | A1 | 6/2015 | Dance et al. | |
| 2016/0130521 | A1 | 5/2016 | Lerasle et al. | |
| 2016/0312144 | A1 | 10/2016 | De Barros Bouchet et al. | |

FOREIGN PATENT DOCUMENTS

| | | | |
|---|---|---|---|
| EP | 1 770 153 | A1 | 4/2007 |
| EP | 2 083 063 | A1 | 7/2009 |
| EP | 2133406 | A1 | 12/2009 |
| EP | 2 966 153 | A1 | 1/2016 |
| FR | 3 014 898 | A1 | 6/1995 |
| JP | 2004-149762 | A | 5/2004 |
| JP | 2005-516107 | A | 6/2005 |
| JP | 2009-197230 | A | 9/2009 |
| JP | 2009-292998 | A | 12/2009 |
| JP | 2012-102281 | A | 5/2012 |
| JP | 2012-512310 | A | 5/2012 |
| JP | 2012-197393 | A | 10/2012 |
| WO | 03/064569 | A1 | 8/2003 |
| WO | 2006/116502 | A1 | 11/2006 |
| WO | 2010/077757 | A2 | 7/2010 |
| WO | 2012/126985 | A1 | 9/2012 |
| WO | 2012/141855 | A1 | 10/2012 |
| WO | 2014/076240 | A1 | 5/2014 |
| WO | 2014/136973 | A1 | 9/2014 |

* cited by examiner

LONG DURATION FUEL ECONOMY LUBRICATING COMPOSITION

This application is a 371 of PCT/EP2016/067481, filed Jul. 22, 2016.

The invention relates to the field of lubricating compositions, in particular to the Fuel Economy (FE) properties of lubricating compositions. The invention relates to the combined use of at least one derivative of molybdenum and at least one derivative of boron to maintain the Fuel Economy (FE) properties of a lubricating composition also comprising at least one base oil.

The invention also relates to the use, within a lubricating composition comprising at least one base oil, of a combination of at least one derivative of molybdenum and at least one derivative of boron to preserve the Fuel Economy (FE) properties of this lubricating composition.

Developments in engines and the performance of engine lubricating compositions are inextricably linked. The more engine design becomes complex, the higher the yield and optimisation of fuel consumption, and the greater the demand placed on engine lubricating compositions for which performance must be improved.

The conditions of use of petrol engines and diesel engines include both extremely short trips and long distances. The journeys travelled by 80% of motor vehicles in Western Europe cover less than 12 kilometres, whereas vehicles clock up annual mileages of up to 300 000 km.

Oil change intervals are also most variable, being 5 000 km for some small diesel engines and may extend to 100 000 km for diesel engines of modern commercial vehicles.

Lubricating compositions, and in particular lubricating compositions for automotive engines, must therefore have improved properties and performance levels.

Engine lubricating compositions must therefore meet numerous objectives.

The lubrication of parts sliding on one another has a determinant role to play, in particular to reduce friction and wear, thereby allowing savings in fuel in particular.

One essential requirement for engine lubricating compositions concerns environment-related aspects. It has effectively become essential to reduce oil consumption and fuel consumption, for the purpose in particular of reducing $CO_2$ emissions.

The type of engine lubricating compositions for motor vehicles has an impact on fuel consumption. Engine lubricating compositions for motor vehicles allowing savings in fuel are often called Fuel Eco compositions.

In the field of automotive lubricants there is therefore a constant search for a reduction in energy losses.

An improvement in Fuel Eco performance levels must therefore be sought. However, this improvement in performance level is insufficient. It must be accompanied by the maintaining or preserving of this Fuel Eco performance level of lubricating compositions.

Throughout the use of a lubricating composition causing ageing thereof, the Fuel Eco performance level must be maintained inasmuch as possible. Any decrease in this Fuel Eco performance reduces the benefits thereof to the same extent. Therefore, in addition to the need to reach a higher level of Fuel Eco performance, it is important to be able to maintain or preserve this Fuel Eco performance of a lubricating composition e.g. between two oil changes or after a certain mileage.

In particular, it is important to be able to have lubricating compositions available that are capable of maintaining a good level of fuel economy of an engine, in particular a vehicle engine.

It is also of importance to have lubricating compositions available that are able to maintain or reduce the coefficient of friction in an engine, in particular in a vehicle engine.

There is therefore a need for engine lubricating compositions, in particular automotive engines, which can bring a solution to all or part of the problems of prior art lubricating compositions.

The invention therefore concerns the combined use of at least one derivative of molybdenum and at least one derivative of boron to preserve the Fuel Economy (FE) properties of a lubricating composition also comprising at least one base oil and at least 30 ppm or at most 600 ppm of boron relative to the weight of the lubricating composition.

Preferably, the invention concerns said use wherein the Fuel Economy properties are measured under Sequence VI-D conditions implemented in accordance with standard ASTM D7589.

Also preferably, the invention concerns said use wherein the Fuel Economy properties are measured in accordance with the Plint SRV test.

Particularly preferably, the invention concerns said use wherein the Fuel Eco properties are measured in accordance with the VI-D test conditions, implemented as per standard ASTM D7589, and with the Plint SRV test.

According to the invention, the test of Plint SRV type is performed in accordance with publication JSAE 9436260 (Frictional Characteristics of Organomolybdenum Compound with Addition of Sulfurized Additives Takashi Kikuchi, Yoko Yonekura, Kenyu Akiyama (Toyota Motor Corporation), pp. 105-108, 13) with the following characteristics:

stroke: 2.2 mm,
frequency: 30 Hz (0.13 $m \cdot s^{-1}$),
load: 150 N,
temperatures (° C.): 40, 50, 60, 70, 80, 90, 100, 110, 120, 140, 160, 180, 200, 240.

According to the invention, the preserving of Fuel Economy properties is preferably measured on the used lubricating composition in comparison with a fresh lubricating composition.

By used lubricating composition, it is more particularly meant an oxidized lubricating composition, the oxidation level of which correspond to the ageing of this composition under true conditions of use.

Preferably, the preserving of Fuel Economy properties is measured on a used composition, preferably after a mileage of about 6 500 miles (10 500 km). The preserving of Fuel Economy properties can also be measured as per an operating time of the engine, corresponding to an interval between two engine oil changes.

In particularly preferred manner according to the invention, the preserving of Fuel Economy properties is higher than 25%, preferably higher than 50%, even higher than 80 or 99%.

The preserving of Fuel Economy properties according to the invention is preferably obtained with an organo-molybdenum compound, in particular a compound selected from among a dithiocarbamate derivative of molybdenum (MoDTC), a dithiophosphate derivative of molybdenum (MoDTP) or a sulfur-free molybdenum complex.

More preferably, the preserving of the Fuel Economy properties according to the invention is obtained with a dithiocarbamate derivative of molybdenum (MoDTC).

Molybdenum dithiocarbamate compounds (MoDTC compound) are complexes formed of a metal core bound to one or more ligands independently selected from among alkyl dithiocarbamate groups. The MoDTC compound of the compositions used in the invention may comprise from 1 to 40%, preferably from 2 to 30%, more preferably from 3 to 28%, further preferably from 4 to 15% by weight of molybdenum relative to the total weight of the MoDTC compound.

The MoDTC compound used in the invention can be selected from among compounds having a core comprising two molybdenum atoms (dimeric MoDTCs) and compounds having a core comprising three molybdenum atoms (trimeric MoDTCs).

Trimeric MoDTC compounds generally have the formula $Mo_3S_kL_n$ where:

- k is an integer of at least 4, preferably ranging from 4 to 10, advantageously from 4 to 7;
- n is an integer ranging from 1 to 4; and
- L is an alkyl dithiocarbamate group having 1 to 100 carbon atoms, preferably 1 to 40 carbon atoms, advantageously 3 to 20 carbon atoms.

As examples of trimeric MoDTC compounds, mention can be made of the compounds and preparation methods thereof described in patent application WO-98-26030.

Preferably, the MoDTC compound employed in the lubricating composition used in the invention is a dimeric MoDTC compound. As examples of dimeric MoDTC compounds, mention can be made of the compounds and preparation methods thereof described in patent application EP-0757093.

Dimeric MoDTC compounds are generally of formula (A):

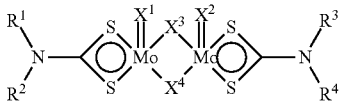

(A)

where:

- $R^1$, $R^2$, $R^3$ and $R^4$, the same or different, are independently a hydrocarbon group selected from among alkyl, alkenyl, aryl, cycloalkyl and cycloalkenyl groups;
- $X^1$, $X^2$, $X^3$ and $X^4$, the same or different, are independently an oxygen atom or sulfur atom.

Advantageously, $R^1$, $R^2$, $R^3$ and $R^4$, the same or different, are independently an alkyl group having 4 to 18 carbon atoms, or an alkenyl group having 2 to 24 carbon atoms.

Also advantageously, $X^1$, $X^2$, $X^3$ and $X^4$ may be the same and represent a sulfur atom, or they may be the same and represent an oxygen atom. Also advantageously, $X^1$ and $X^2$ may represent a sulfur atom and $X^3$ and $X^4$ may represent an oxygen atom. Also advantageously, $X^1$ and $X^2$ may represent an oxygen atom and $X^3$ et $X^4$ may represent a sulfur atom.

The MoDTC compound of formula (A) may also be selected from among at least one symmetric MoDTC compound, at least one asymmetric MoDTC compound and combinations thereof. By symmetric MoDTC compound is meant a MoDTC compound of formula (A) where the $R^1$, $R^2$, $R^3$ and $R^4$ groups are the same. By asymmetric MoDTC compound is meant a MoDTC compound of formula (A) where the groups $R^1$ and $R^2$ are the same, the groups $R^3$ and $R^4$ are the same, and the groups $R^1$ and $R^2$ differ from the groups $R^3$ and $R^4$.

Advantageously, the lubricating composition of the invention may comprise a mixture of at least one symmetric MoDTC compound and at least one asymmetric MoDTC compound. More advantageously $R^1$ and $R^2$, the same, then represent an alkyl group having 5 to 15 carbon atoms and $R^3$ and $R^4$, the same but differing from $R^1$ and $R^2$, represent an alkyl group having 5 to 15 carbon atoms. Preferably $R^1$ and $R^2$, the same, represent an alkyl group having 6 to 10 carbon atoms and $R^3$ and $R^4$ represent an alkyl group having 10 to 15 carbon atoms.

Similarly $R^1$ and $R^2$, the same, may represent an alkyl group having 10 to 15 carbon atoms, and $R^3$ and $R^4$ may represent an alkyl group having 6 to 10 carbon atoms.

Also $R^1$ and $R^2$, $R^3$ and $R^4$, when the same, may represent an alkyl group having 5 to 15 carbon atoms, preferably 8 to 13 carbon atoms.

Advantageously, the MoDTC compound is selected from among the compounds of formula (A) where:

- $X^1$ and $X^2$ are an oxygen atom,
- $X^3$ and $X^4$ are a sulfur atom,
- $R^1$ is an alkyl group having 8 carbon atoms or an alkyl group having 13 carbon atoms,
- $R^2$ is an alkyl group having 8 carbon atoms or an alkyl group having 13 carbon atoms,
- $R^3$ is an alkyl group having 8 carbon atoms or an alkyl group having 13 carbon atoms,
- $R^4$ is an alkyl group having 8 carbon atoms or an alkyl group having 13 carbon atoms.

Therefore, advantageously, the MoDTC compound can be selected from among the compounds of formula (A1):

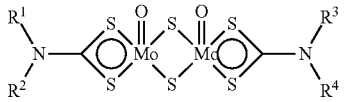

(A1)

where $R^1$, $R^2$, $R^3$ and $R^4$ are such as defined for formula (A).

Advantageously, the MoDTC compound is a mixture of:

- a formula (A1) MoDTC compound where $R^1$, $R^2$, $R^3$ and $R^4$ are an alkyl group having 8 carbon atoms,
- a formula (A1) MoDTC compound where $R^1$, $R^2$, $R^3$ and $R^4$ are an alkyl group having 13 carbon atoms, and
- a formula (A1) MoDTC compound where $R^1$ and $R^2$ are an alkyl group having 13 carbon atoms and $R^3$ and $R^4$ are an alkyl group having 8 carbon atoms, and/or
- a formula (A1) MoDTC compound where $R^1$ and $R^2$ are an alkyl group having 8 carbon atoms and $R^3$ and $R^4$ are an alkyl group having 13 carbon atoms.

By alkyl group in the meaning of the invention is meant a straight-chain or branched hydrocarbon group having 1 to 24 carbon atoms. The alkyl group can be selected from the group formed by methyl, ethyl, propyl, isopropyl, n-butyl, iso-butyl, tert-butyl, n-pentyl, iso-pentyl, neopentyl, hexyl, heptyl, octyl, nonyl, decyl, undecyl, dodecyl, tridecyl, isotridecyl, tetradecyl, hexadecyl, stearyl, icosyl, docosyl, tetracosyl, triacontyl, 2-ethylhexyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, myristyl, palmityl and stearyl.

By alkenyl group in the meaning of the present invention is meant a straight-chain or branched hydrocarbon group having at least one double bond and 2 to 24 carbon atoms. The alkenyl group can be selected from among vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleic.

By aryl group in the meaning of the present invention is meant a polycyclic aromatic hydrocarbon or an aromatic group substituted or unsubstituted by an alkyl group. The aryl group has 6 to 24 carbon atoms. For example, the aryl group may be phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, phenylphenyl, benzylphenyl, phenyl-styrene, p-cumylphenyl and naphthyl.

In the meaning of the present invention, the cycloalkyl groups and cycloalkenyl groups comprise, but not limited thereto, cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl. The cycloalkyl groups and cycloalkenyl groups may have 3 to 24 carbon atoms.

The (S:O) ratio of the number of sulfur atoms to the number of oxygen atoms of the MoDTC compound may generally vary from (1:3) to (3:1).

As particular examples of MoDTC compounds, mention can be made of the products Molyvan L®, Molyvan 807® or Molyvan 822® marketed by R.T Vanderbilt Company, or the products Sakuralube 200®, Sakuralube 165®, Sakuralube 525® or Sakuralube 600® marketed by Adeka.

The MoDTC compound of the compositions used in the invention particularly allows a reduction in the coefficient of friction under boundary and mixed lubrication regimes. Without being bound by any particular theory, this compound is adsorbed on metal surfaces to form an anti-friction film with low shear resistance.

The lubricating composition used in the invention may also be employed with an organo-molybdenum compound selected from among the MoDTC compounds described in patent application WO-2012-141855.

Similarly, it can be employed with a complex organo-molybdenum compound or a MoDTP compound selected from among the compounds described in patent applications WO-2014-076240 and FR-3014898.

Advantageously, the MoDTP compound is selected from among the compounds of formula (B):

(B)

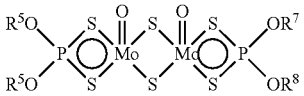

where $R^5$, $R^6$, $R^7$ and $R^8$, the same or different, are independently a hydrocarbon group selected from among alkyl, alkenyl, aryl, cycloalkyl or cycloalkenyl groups.

As examples of MoDTP compounds, mention can be made of the product Molyvan L® marketed by R.T Vanderbilt Company, or the Sakura-lube 300® or Sakura-lube 310G® products marketed by Adeka.

It may also be employed with a sulfur-free and phosphorus-free organo-molybdenum complex compound. This sulfur- and phosphorus-free organo-molybdenum complex can be prepared using ligands of amide type, chiefly prepared by reaction of a molybdenum source e.g. molybdenum trioxide, with an amine and fatty acid derivative having 4 to 28 carbon atoms for example, preferably 8 to 18 carbon atoms. Examples of fatty acids are those derived from vegetable or animal oils. This organo-molybdenum complex can be prepared following methods described in U.S. Pat. No. 4,889,647, EP-0546357, U.S. Pat. No. 5,412,130, EP-1770153. One preferred organo-molybdenum complex is obtained by reaction of:

(i) a fatty acid or fat of mono-, di- or tri-glyceride type, (ii) an amine source of formula (C):

(C)

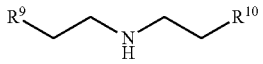

where $R^9$ and $R^{10}$, the same or different, are independently an OH or $NH_2$ group, (iii) a molybdenum source selected from among molybdenum trioxide or molybdates, preferably ammonium molybdate, in sufficient amount to afford 0.1 to 30%, preferably 2 to 8.5% by weight of molybdenum relative to the weight of the complex.

Preferably, the organo-molybdenum complex comprises at least one compound of formula (D) or of formula (E) or a mixture thereof:

(D)

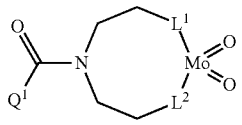

(E)

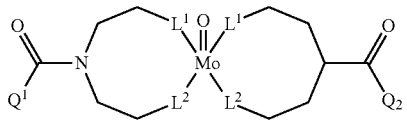

where:

$L^1$ and $L^2$, the same or different, are independently O or NH, $Q^1$ and $Q^2$, the same or different, are independently a straight-chain or branched, saturated or unsaturated alkyl group having 3 to 30 carbon atoms, preferably 3 to 20 carbon atoms, advantageously 7 to 17 carbon atoms.

This organo-molybdenum complex can be prepared by reaction of:

(i) a fatty acid or fat of mono-, di- or tri-glyceride type, (ii) diethanolamine or 2-(2-aminoethyl) aminoethanol, (iii) a molybdenum source selected from among molybdenum trioxide or molybdates, preferably ammonium molybdate, in sufficient amount to afford 0.1 to 20% by weight of molybdenum relative to the weight of the complex.

More preferably, the organo-molybdenum complex comprises at least one compound of formula (D1) or formula (D2) or a mixture thereof:

(D1)

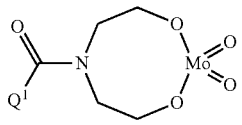

-continued (D2)

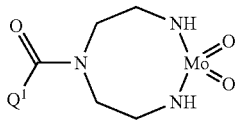

where $Q^1$ is independently a straight-chain or branched, saturated or unsaturated alkyl group having 3 to 30 carbon atoms, preferably 3 to 20 carbon atoms, advantageously 7 to 17 carbon atoms.

The preserving of Fuel Economy properties according to the invention is preferably obtained with a derivative of boron selected from among the derivatives of boric acid, derivatives of boronic acid, boronates, borates, borated dispersants such as succinimide derivatives of boron in particular borated polyisobutylene succinimide, borated detergents, simple orthoborates, borate epoxides or borate esters. More preferably, the preserving of Fuel Economy properties according to the invention is obtained with the borate esters of $C_{10}$-$C_{24}$ fatty acids or with borated dispersants such as succinimide derivatives of boron in particular borated polyisobutylene succinimide.

Preferably, the use of the invention concerns a lubricating composition comprising at least 30 ppm or at most 2 000 ppm of molybdenum relative to the weight of the lubricating composition. More preferably, the use of the invention concerns a lubricating composition comprising from 30 to 2 000 ppm of molybdenum relative to the weight of the lubricating composition, or from 50 to 1 000 ppm, or from 100 to 600 ppm of molybdenum relative to the weight of the lubricating composition.

Also preferably, the use of the invention concerns a lubricating composition comprising from 50 to 500 ppm of boron relative to the weight of the lubricating composition.

The amount of molybdenum, in particular of MoDTC compounds, in the lubricating composition used in the invention can be measured using the ISO NFT 60106 method.

Also preferably, the invention concerns a use in which the weight ratio between molybdenum and boron is between 3:80 and 400:3, or between 2:1 and 400.3, or between 3:80 and 5:2, or between 2:1 and 5:2.

The lubricating composition used in the invention comprises at least one molybdenum derivative and at least one boron derivative and at least one base oil. This base oil can be selected from among numerous oils. The base oil of the lubricating composition used in the invention may notably be selected from among oils of mineral or synthetic origin belonging to groups I to V in the classes defined by the API classification (or equivalents thereof in the ATIEL classification) (Table A) or mixtures thereof.

TABLE A

| | Saturates content | Sulfur content | Viscosity Index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | polyalphaolefins (PAOs) | | |
| Group V | esters and other bases not included in Groups I to IV | | |

The mineral base oils that can be used in the invention include all types of bases obtained by atmospheric or vacuum distillation of crude oil, followed by refining operations such as solvent extraction deasphalting, solvent dewaxing, hydrotreatment, hydrocracking, hydroisomerization and hydrofinishing. Mixtures of synthetic and mineral oils can also be employed.

There is generally no limit as to the use of different lubricating bases to produce the lubricating compositions of the invention, other than that they must have properties in particular of viscosity, viscosity index, sulfur content and oxidation resistance that are adapted for use in engines.

The base oils of the lubricating compositions used in the invention can also be selected from among synthetic oils such as some esters of carboxylic acids and alcohols, polyalkylene glycols (PAGs), and from among polyalphaolefins.

Numerous additives can be used for the lubricating composition used in the invention.

The preferred additives for the lubricating composition used in the invention are selected from among detergent additives, anti-wear additives, friction modifying additives with the exception of friction modifiers containing molybdenum, extreme pressure additives, dispersants, pour point depressants, viscosity index improvers, defoaming agents, thickeners and mixtures thereof.

The lubricating composition used in the invention may comprise at least one pour point depressant (PPD agent). By slowing the formation of paraffin crystals, pour point depressants generally improve the behaviour under cold conditions of the lubricating composition used in the invention. As examples of pour point depressants, mention can be made of alkyl polymethacrylates, polyacrylates, polyarylamides, polyalkylphenols, polyalkylnaphthalenes, alkylated polystyrenes.

The lubricating composition used in the invention may also comprise at least one anti-wear additive, at least one extreme pressure additive or mixtures thereof. Preferably, the lubricating composition used in the invention comprises at least one anti-wear additive.

Anti-wear additives and extreme pressure additives protect friction surfaces through the formation of a protective film adsorbed on these surfaces. There exists a wide variety of anti-wear additives. Preferably for the lubricating composition used in the invention, the anti-wear additives are selected from among phospho-sulfurized additives such as metal alkylthiophosphates, in particular zinc alkylthiophosphates, and more specifically zinc dialkyldithiophosphates or ZnDTPs. The preferred compounds have the formula $Zn((SP(S)(OR^a)(OR^b))_2$, where $R^a$ and $R^b$, the same or different, are each independently an alkyl group, preferably an alkyl group having 1 to 18 carbon atoms. Amine phosphates are also anti-wear additives that can be used in the lubricating composition used in the invention. However, the phosphorus contributed by these additives may act as poison for catalytic systems of motor vehicles since these additives generate ash. These effects can be minimised by partly substituting amine phosphates by additives that do not contain phosphorus such as polysulfides for example, in particular sulfurized olefins. Advantageously, the lubricating composition used in the invention may comprise from 0.01 to 6% by weight, preferably from 0.05 to 4% by weight, more preferably from 0.1 to 2% by weight of anti-wear additives and extreme pressure additives relative to the total weight of the lubricating composition.

Advantageously, the lubricating composition used in the invention may comprise at least one friction modifying additive. The friction modifying additive can be selected from among a compound providing metal elements and an ash-free compound. Among the compounds providing metal elements, mention can be made of transition metal complexes such as Sb, Sn, Fe, Cu, Zn, the ligands of which may be hydrocarbon compounds comprising atoms of oxygen, nitrogen, sulfur or phosphorus. The ash-free friction modifying additives are generally or organic origin and can be selected from among the monoesters of fatty acids and polyols, alkoxylated amines, alkoxylated fatty amines, fatty epoxides, borate fatty epoxides; fatty amines or fatty acid glycerol esters. According to the invention, the fatty compounds comprise at least one hydrocarbon group having 10 to 24 carbon atoms. Advantageously, the lubricating composition used in the invention may comprise from 0.01 to 2% by weight or from 0.01 to 5% by weight, preferably from 0.1 à 1.5% by weight or from 0.1 to 2% by weight of friction modifying additive relative to the total weight of the lubricating composition.

Advantageously, the lubricating composition used in the invention may comprise at least one antioxidant additive. An antioxidant additive generally allows delayed degradation of a lubricating composition when in use. This degradation may notably translate as the formation of deposits, as the presence of sludge or as an increase in viscosity of the lubricating composition. Antioxidant additives particularly act as radical inhibitors or hydroperoxide decomposers. Among the antioxidant additives frequently employed, mention can be made of antioxidant additives of phenolic type, antioxidant additives of amino type, phosphor-sulfurized antioxidant additives. Some of these antioxidant additives e.g. phospho-sulfurized antioxidant additives may generate ash. Phenolic antioxidant additives may be ash-free or may be in the form of neutral or basic metal salts. Antioxidant additives can be selected in particular from among sterically hindered phenols, sterically hindered phenol esters and sterically hindered phenols comprising a thioether bridge, diphenylamines, diphenylamines substituted by at least one $C_1$-$C_{12}$ alkyl group N,N'-dialkyl-aryl-diamines, and mixtures thereof. Preferably, according to the invention, the sterically hindered phenols are selected from among compounds comprising a phenol group wherein at least one vicinal carbon of the carbon carrying the alcohol function is substituted by at least one $C_1$-$C_{10}$ alkyl group, preferably a $C_1$-$C_6$ alkyl group, preferably a $C_4$ alkyl group, preferably by the tert-butyl group. Amino compounds are another class of antioxidant additives that can be used, optionally in combination with phenolic antioxidant additives. Examples of amino compounds are the aromatic amines e.g. the aromatic amines of formula $NR^cR^dR^e$ where $R^c$ is an aliphatic group or aromatic group, optionally substituted, $R^d$ is an aromatic group, optionally substituted, $R^e$ is a hydrogen atom, an alkyl group, an aryl group or a group of formula $R^fS(O)_zR^g$ where $R^f$ is an alkylene group or alkenylene group, $R^g$ is an alkyl group, an alkenyl group or aryl group and z is 0, 1 or 2. Sulfurized alkyl phenols or the alkaline or alkaline-earth metal salts thereof can also be used as antioxidant additives. Another class of antioxidant additives is that of copper compounds e.g. copper thio- or dithiophosphates, copper and carboxylic acid salts, copper dithiocarbamates, sulfonates, phenates and acetylacetonates. Copper I and II salts, the salts of succinic acid or anhydride can also be used. The lubricating composition of the invention may contain any type of antioxidant additives known to persons skilled in the art. Advantageously, the lubricating composition comprises at least one ash-free antioxidant additive. Also advantageously, the lubricating composition used in the invention comprises from 0.5 to 2% by weight of at least one antioxidant additive relative to the total weight of the composition.

The lubricating composition of the invention may also comprise at least one detergent additive. Detergent additives generally allow a reduction in the formation of deposits on the surface of metal parts by dissolving secondary oxidation and combustion products.

The detergent additives that can be employed in the lubricating composition used in the invention are generally known to persons skilled in the art. The detergent additives may be anionic compounds comprising a long lipophilic hydrocarbon chain and hydrophilic head. The associated cation may be a metal cation of an alkaline or alkaline-earth metal. The detergent additives are preferably selected from among the salts of alkaline metals or alkaline-earth metals of carboxylic acids, sulfonates, salicylates, naphthenates, and phenate salts. The alkaline or alkaline-earth metals are preferably calcium, magnesium, sodium or barium. These metal salts generally comprise the metal in stoichiometric amount or in excess i.e. an amount greater than the stoichiometric amount. They are then overbased detergent additives; the excess metal imparting the overbased nature to the detergent additive is then generally in the form of an oil-insoluble metal salt e.g. a carbonate, hydroxide, an oxalate, acetate, glutamate, preferably a carbonate. Advantageously, the lubricating composition of the invention may comprise 2 to 4% by weight of detergent additive relative to the total weight of the lubricating composition.

Advantageously, the lubricating composition used in the invention may also comprise at least one dispersant. The dispersant can be selected from among Mannich bases, succinimides and derivatives thereof. Also advantageously, the lubricating composition used in the invention may comprise 0.2 to 10% by weight of dispersant relative to the total weight of the lubricating composition.

Advantageously, the lubricating composition may also comprise at least one polymer to improve the viscosity index. As examples of polymers improving the viscosity index, mention can be made of the polymer esters, homopolymers or copolymers, hydrogenated or non-hydrogenated, of styrene, butadiene and isoprene, polymethacrylates (PMAs). Also advantageously, the lubricating composition used in the invention may comprise from 1 to 15% by weight of polymer improving the viscosity index relative to the total weight of the lubricating composition.

Preferably, the use of the invention comprises the preserving of the fuel economy of an engine, preferably an automotive engine, measured under VI-D test conditions implemented in accordance with standard ASTM D7589.

More preferably, the use of the invention comprises the preserving of the fuel economy of an engine preferably an automotive engine, that is higher than 25%, more preferably higher than 50% even higher than 80 or 99%.

Also preferably, the use of the invention comprises the reduced degradation or maintaining of the coefficient of friction in an engine, preferably an automotive engine, measured in accordance with the Plint SRV test.

More preferably the use of the invention comprises the maintaining of the coefficient of friction or a reduction in degradation thereof of 25% or less, more preferably of 50% or less, even of 80 or 99% or less.

Also preferably, the use of the invention comprises the extended duration over time of the properties of the molybdenum derivative used. In particular, the use of the invention allows the extended duration over time of the properties of the molybdenum derivative as lubricating agent.

Also preferably, the use of the invention comprises the extended duration over time of the performance of the molybdenum derivative used. In particular, the use of the invention allows the extended duration over time of the performance of the molybdenum derivative as anti-friction agent.

The invention concerns the combined use of at least one derivative of molybdenum and at least one derivative of boron to preserve the Fuel Economy (FE) properties of a lubricating composition also comprising at least one base oil. The molybdenum derivative and boron derivative may then be provided separately and then combined in the lubricating composition used in the invention.

The invention also concerns the use of a combination of at least one derivative of molybdenum and at least one derivative of boron in a lubricating composition also comprises at least one base oil, and at least 30 ppm or at most 600 ppm of boron relative to the weight of the lubricating composition, to preserve the Fuel Economy (FE) properties of this lubricating composition. The molybdenum derivative and boron derivative are then provided in the form of a combination in the lubricating composition used in the invention.

The invention also concerns a method for lubricating an engine, preferably an automotive engine, by means of a combination of at least one derivative of molybdenum and at least one derivative of boron in a lubricating composition also comprising at least one base oil and at least 30 ppm or at most 600 ppm of boron, allowing the preserving of the Fuel Economy (FE) properties of this lubricating composition. The molybdenum derivative and boron derivative are then provided separately or else in the form of a combination in the lubricating composition used in the invention. The lubrication method of the invention comprises at least one step to contact at least one part of an engine with a lubricating composition used in the invention.

The invention also concerns a method for preserving the Fuel Economy properties of a lubricating composition comprising at least one base oil, comprising at least one step to add to the lubricating composition at least one molybdenum derivative and at least one boron derivative, and at least 30 ppm or at most 600 ppm of boron.

The particular, advantageous or preferred characteristics of the combined use of the invention define particular, advantageous or preferred combinations that can be used in the invention.

The different aspects of the invention can be illustrated by the following examples.

EXAMPLE 1

Preparation and Evaluation of a Lubricating Composition Used in the Invention (1) and of Comparative Lubricating Compositions (1), (2) and (3)

The lubricating compositions were prepared by mixing the compounds described in Table 1. The indicated percentages correspond to weight percentages relative to the total weight of the composition.

TABLE 1

| | Composition | | | |
|---|---|---|---|---|
| | of the invention | comparative | | |
| | (1) | (1) | (2) | (3) |
| Group III base oils | 80.25 | 81.45 | 80.75 | 80.25 |
| Viscosity index improving polymers (PISH + PMA) | 6.0 | 6.0 | 6.0 | 6.0 |
| Mixture of additives (dispersant, detergents of salicylate type, anti-wear of zinc dithiophosphate type) | 10.25 | 10.25 | 10.25 | 10.25 |
| Pour point depressant (PPD) | 0.3 | 0.3 | 0.3 | 0.3 |
| Antioxidants (combination of phenolic antioxidant + amino antioxidant) | 1.5 | 1.5 | 1.5 | 1.5 |
| Borated ester | 0.5 | 0.5 | 0 | 0 |
| Non-borated ester | 0 | 0 | 0 | 0.5 |
| Friction modifiers: combination of MoDTP (Sakuralube 300 ® by Adeka) + Mo-DTC (Sakuralube 525 ® by Adeka) | 1.2 | 0 | 1.2 | 1.2 |
| Boron content (ppm) | 133 | 133 | 0 | 0 |
| Molybdenum content (ppm) | 1 154 | 0 | 1 154 | 1 154 |

The lubricating compositions were subjected to a test of Plint SRV type such as described in the publication JSAE 9436260 (Frictional Characteristics of Organomolybdenum Compound with Addition of Sulfurized Additives Takashi Kikuchi, Yoko Yonekura, Kenyu Akiyama (Toyota Motor Corporation), pp. 105-108, 13) with:

stroke: 2.2 mm, frequency: 30 Hz (0.13 m/s), load: 150 N, temperatures (° C.): 40, 50, 60, 70, 80, 90, 100, 110, 120, 140, 160, 180, 200, 240.

The results are given in Table 2.

TABLE 2

| | Composition (1) of the invention | Comparative composition (1) | Comparative composition (2) | Comparative composition (3) |
|---|---|---|---|---|
| Mean coefficient of friction (μm) | 0.044 | 0.125 | 0.049 | 0.047 |

The same test was applied to the lubricating compositions after ageing i.e. subjected to oxidation under bubbling of air (10 L/h) for 96 h at a temperature of 150° C. The results are given in Table 3.

TABLE 3

| | Composition of the invention after ageing | Comparative composition after ageing | | |
|---|---|---|---|---|
| | (1) | (1) | (2) | (3) |
| Mean coefficient of friction (μm) | 0.052 | 0.127 | 0.110 | 0.112 |

The lubricating compositions used in the invention have improved friction properties compared with lubricating compositions comprising either at least one derivative of molybdenum alone or a derivative of boron alone. These properties are sustained over time, even after ageing.

Therefore, the lubricating compositions used in the invention afford improved performance to maintain a significant gain in fuel economy over time, even after ageing.

EXAMPLE 2

Evaluation of the Gain in Fuel Economy Performance of the Lubricating Composition (1) Used in the Invention The preserved Fuel Economy performance of the lubricating composition (1) used in the invention was evaluated with the Sequence VI-D test, in accordance with standard ASTM D7589.

To meet this Sequence VI.D test:

the value for the aged oil (FEI 2) must be at least 1.2%, the sum of the values for fresh oil (FEI 1) and aged oil (FEI 2) must be at least 2.6%.

The results obtained are given in Table 4.

TABLE 4

| | Composition (1) used in the invention |
|---|---|
| FEI 2 (%) | 2.32 |
| FEI 1 + FEI 2 (%) | 3.66 |

The lubricating composition used in the invention successfully passed the Sequence VI-D test and therefore exhibits good Fuel Eco performance. This performance is sustained over time even after ageing.

EXAMPLE 3

Preparation and Evaluation of Lubricating Compositions (2), (3) and (4) Used in the Invention and of Comparative Lubricating Compositions (4), (5) and (6)

The lubricating compositions were prepared by mixing the compounds described in Table 5. The indicated percentages correspond to weight percentages relative to the total weight of the composition.

TABLE 5

| | Composition | | | | | |
|---|---|---|---|---|---|---|
| | of the invention | | | comparative | | |
| | (2) | (3) | (4) | (4) | (5) | (6) |
| Group III base oils | 85.9 | 87.1 | 88.5 | 85.9 | 86.1 | 86.1 |
| Viscosity Index improving polymer (PISH) | 5.3 | 5.3 | 5.3 | 5.3 | 5.3 | 5.3 |
| Pour point depressant (PPD) | 0.3 | 0.3 | 0.3 | 0.3 | 0.3 | 0.3 |
| Antioxidants (combination of phenolic antioxidant + amino antioxydant) | 1.5 | 1.5 | 1.5 | 1.5 | 1.5 | 1.5 |
| Mixture of additives (detergents of sulfonate type, anti-wear of zinc dithiophosphate type) | 2.8 | 2.8 | 2.8 | 2.8 | 2.8 | 2.8 |
| Friction modifiers (Mo-DTC (Sakuralube 525 ® by Adeka)) | 0.2 | 0.2 | 0.2 | 0.2 | 0 | 0 |
| Non-borated dispersant (polyisobutylene succinimide) | 0 | 0 | 0 | 4 | 0 | 4 |
| Borated dispersant (borated polyisobutylene succinimide comprising 0.35 wt. % boron) | 4 | 2.8 | 1.4 | 0 | 4 | 0 |
| Boron content (ppm) | 140 | 100 | 50 | 0 | 140 | 0 |
| Molybdenum content (ppm) | 200 | 200 | 200 | 200 | 0 | 0 |

The Plint SRV test of Example 1 was applied to fresh lubricating compositions and to lubricating compositions aged under the same conditions as described in Example 1. The results for fresh oils and aged oils are given in Tables 6 and 7 respectively.

TABLE 6

| | Composition of the invention | | | Comparative composition | | |
|---|---|---|---|---|---|---|
| | (2) | (3) | (4) | (4) | (5) | (6) |
| Mean coefficient of friction (μm) | 0.056 | 0.056 | 0.056 | 0.056 | 0.147 | 0.145 |

TABLE 7

| | Composition of the invention | | | Comparative composition | | |
|---|---|---|---|---|---|---|
| | (2) | (3) | (4) | (4) | (5) | (6) |
| Mean coefficient of friction (μm) | 0.059 | 0.061 | 0.065 | 0.110 | ≥0.147 | ≥0.145 |

These results confirm those of Example 1. The lubricating compositions used in the invention exhibit improved friction properties compared with the lubricating compositions comprising at least one molybdenum derivative alone or a derivative of boron alone. These properties are sustained over time. As a result, the lubricating compositions used in the invention provide improved performance to maintain a significant gain in fuel savings over time.

The invention claimed is:

1. Method for preserving the Fuel Economy (FE) properties of a lubricating composition comprising at least one base oil, comprising the addition to the lubricating composition of at least one derivative of molybdenum and at least one derivative of boron, the final lubricating composition comprising at least 140 ppm and at most 600 ppm of boron relative to the weight of the lubricating composition, and at least 200 ppm and at most 600 ppm of molybdenum relative to the weight of the lubricating composition, and wherein the weight ratio of molybdenum to boron is from 2:1.4 to 5:2;

wherein the derivative of molybdenum is an organomolybdenum compound selected from the group consisting of a dithiocarbamate derivative of molybdenum (MoDTC), a dithiophosphate derivative of molybdenum (MoDTP) and a sulfur-free molybdenum complex; and wherein the boron derivative is selected from the group consisting of the derivatives of boric acid, the derivatives of boronic acid, boronates, borates, borated dispersants, borated detergents, simple orthoborates, borate epoxides and borate esters.

2. The method according to claim 1, wherein the Fuel Economy properties are measured:

in accordance with Sequence VI-D conditions implemented as per standard ASTM D7589; or in accordance with the Plint SRV test; or in accordance with VI-D test conditions implemented as per standard ASTM D7589 and in accordance with the Plint SRV test.

3. The method according to claim 1, wherein the preserving of Fuel Economy properties is measured on the used lubricating composition in comparison with the fresh lubricating composition.

4. The method according to claim 1, wherein the preserving of Fuel Economy properties is measured on the used composition.

5. The method according to claim 1, wherein the preserving of Fuel Economy properties is higher than 25% as measured under VI-D test conditions implemented in accordance with standard ASTM D7589.

6. The method according to claim 1, wherein the lubricating composition also comprises at least one anti-wear additive.

7. The method according to claim 1, comprising the preserving of the Fuel Economy of a motor vehicle measured in accordance with VI-D test conditions implemented as per standard ASTM D7589.

8. The method according to claim 1, comprising the maintaining or reduced degradation of the coefficient of friction in a vehicle engine measured with the Plint SRV test.

9. The method according to claim 1, wherein the weight ratio of molybdenum to boron is from 2:1 to 5:2.

* * * * *